US009638001B2

(12) United States Patent
Veeken et al.

(10) Patent No.: US 9,638,001 B2
(45) Date of Patent: May 2, 2017

(54) METHOD FOR PRODUCING HYDROCARBON GAS FROM A WELLBORE AND VALVE ASSEMBLY

(71) Applicant: SHELL OIL COMPANY, Houston, TX (US)

(72) Inventors: Cornelis Adrianus Maria Veeken, Assen (NL); Lubbertus Lugtmeier, Assen (NL); Derk Lucas Klompsma, Sappemeer (NL); Ewout Norbert Jan Biezen, Assen (NL)

(73) Assignee: SHELL OIL COMPANY, Houston, TX (US)

( * ) Notice: Subject to any disclaimer, the term of this patent is extended or adjusted under 35 U.S.C. 154(b) by 332 days.

(21) Appl. No.: 14/378,197

(22) PCT Filed: Feb. 12, 2013

(86) PCT No.: PCT/EP2013/052756
§ 371 (c)(1),
(2) Date: Aug. 12, 2014

(87) PCT Pub. No.: WO2013/120837
PCT Pub. Date: Aug. 22, 2013

(65) Prior Publication Data

US 2015/0000929 A1 Jan. 1, 2015

(30) Foreign Application Priority Data

Feb. 14, 2012 (EP) ..... 121255337

(51) Int. Cl.
*E21B 43/12* (2006.01)
*E21B 34/10* (2006.01)
(Continued)

(52) U.S. Cl.
CPC ..... *E21B 34/10* (2013.01); *E21B 17/18* (2013.01); *E21B 17/203* (2013.01); *E21B 34/105* (2013.01); *E21B 43/123* (2013.01)

(58) Field of Classification Search
CPC .... E21B 43/121; E21B 43/122; E21B 34/105; E21B 43/12; E21B 34/10; E21B 2034/007
See application file for complete search history.

(56) References Cited

U.S. PATENT DOCUMENTS 2,144,144 A 1/1939 Crickmer
2,244,684 A 6/1941 Foran
(Continued)

FOREIGN PATENT DOCUMENTS

EP 608081 7/1994
EP 638372 2/1995
(Continued)

OTHER PUBLICATIONS

Bolt, David: Advancements in Hydraulic Dewatering Technology, 7th European Gas Well Deliquification Conference Hydraulic Dewatering Introduction and History, Sep. 24, 2012 (Sep. 24, 2012), XP55144810, Groningen Retrieved from the Internet: URL:http://alrdc.com/workshops/2013_2013EuropeanGasWel1/Private/19_EGWDC2013_New hydraulic piston pumps_Cormorant.pdf [retrieved on Oct. 7, 2014].
(Continued)

*Primary Examiner* — Kipp Wallace

(57) ABSTRACT

The present invention provides a method for producing hydrocarbon gas from a wellbore and a control valve assembly for said wellbore. The wellbore comprises a wellhead, a production zone, a production tubing, and a velocity string installed inside the production tubing. The method comprises allowing gas to flow from the production zone through the velocity string, said gas forming a primary gas
(Continued)

stream, and controlling the flow of gas from the annulus between the outer wall of the velocity string and the inner wall of the production tubing to the primary gas stream by means of the control valve wherein a controlled mass flow of said gas is combined with the primary gas stream.

15 Claims, 5 Drawing Sheets

(51) Int. Cl.
*E21B 17/18* (2006.01)
*E21B 17/20* (2006.01)

(56) References Cited

U.S. PATENT DOCUMENTS 2,309,383 A * 1/1943 Crites ..... E21B 43/122 417/147
3,130,789 A 4/1964 Alexander et al.
3,292,706 A 12/1966 Grimmer et al.
3,411,584 A 11/1968 Sizer et al.
3,417,827 A 12/1968 Smith et al.
3,739,846 A 6/1973 Beson
3,845,784 A 11/1974 Sullivan
3,878,312 A 4/1975 Bergh et al.
4,042,033 A 8/1977 Holland et al.
4,072,166 A 2/1978 Tiraspolsky et al.
4,260,020 A 4/1981 Nelson et al.
4,311,584 A 1/1982 Smith et al.
4,354,554 A * 10/1982 Calhoun ..... E21B 33/12 166/105.5
4,399,871 A 8/1983 Adkins et al.
4,487,221 A 12/1984 Zwart
4,589,482 A * 5/1986 Bayh, III ..... E21B 23/03 166/105.5
4,632,184 A * 12/1986 Renfroe, Jr. ..... E21B 33/1294 166/105.5
5,027,903 A 7/1991 Gipson
5,048,611 A 9/1991 Cochran
5,125,457 A 6/1992 Meaders
5,141,057 A * 8/1992 Chaix ..... E21B 17/18 166/316
5,209,946 A 5/1993 Lowther et al.
5,343,945 A * 9/1994 Weingarten ..... E21B 43/38 166/105.5
6,179,056 B1 * 1/2001 Smith ..... E21B 43/121 166/105.5
6,382,321 B1 5/2002 Bates et al.
6,427,773 B1 8/2002 Albers
6,494,265 B2 12/2002 Wilson et al.
6,702,028 B1 * 3/2004 Heggholmen ..... E21B 43/121 166/105.5
7,063,162 B2 6/2006 Daling et al.
7,066,264 B2 6/2006 Bissonnette et al.
7,559,296 B2 7/2009 Perotto
8,220,534 B2 7/2012 Millet et al.
8,631,875 B2 1/2014 Nguyen et al.
9,181,776 B2 * 11/2015 Tunget ..... E21B 41/0035
2002/0074129 A1 6/2002 Moore
2002/0157837 A1 10/2002 Bode et al.
2003/0056958 A1 3/2003 Allan
2003/0106588 A1 6/2003 Zahe
2004/0035584 A1 2/2004 Gleim et al.
2005/0061221 A1 3/2005 Paszkowski
2005/0173125 A1 8/2005 Naquin et al.
2005/0233086 A1 10/2005 Chan et al.
2005/0252997 A1 11/2005 Gluck et al.
2006/0021750 A1 * 2/2006 Lugtmeier ..... E21B 34/105 166/169
2006/0235175 A1 10/2006 Baradie et al.
2007/0108380 A1 5/2007 Poe et al.
2008/0271893 A1 * 11/2008 Hill ..... E21B 33/068 166/305.1
2008/0286556 A1 11/2008 D'urso et al.
2009/0200013 A1 8/2009 Craster et al.
2009/0255684 A1 10/2009 Bolding
2010/0051289 A1 3/2010 Constantine et al.
2010/0096127 A1 4/2010 Jordy
2010/0126725 A1 5/2010 Ravensbergen
2011/0048724 A1 3/2011 Pringle et al.
2013/0043031 A1 * 2/2013 Tunget ..... E21B 21/12 166/313
2013/0075111 A1 * 3/2013 Ellis ..... E21B 34/10 166/374
2013/0133896 A1 5/2013 Tveiten et al.
2013/0153239 A1 6/2013 McIntosh et al.
2014/0182857 A1 7/2014 Klompsma et al.
2015/0240594 A1 8/2015 Klompsma et al.

FOREIGN PATENT DOCUMENTS

EP 2128378 12/2009
GB 2172321 9/1986
GB 2479432 A 10/2011
WO 2005045183 5/2005
WO 2006069247 6/2006
WO 2006133351 12/2006
WO 2008002473 1/2008
WO 2013004609 1/2013

OTHER PUBLICATIONS

Furrow, B., et al.: Gas Well Deliquification, Workshop Selection & Validation of Hydraulic Dewatering Pumps in the Natural Gas Dewatering Pumps in the Natural Gas Industry: An Update Brendan Furrow, Business Development Manager, Apr. 25, 2012 (Apr. 25, 2012), XP55144841, Retrieved from the Internet: URL:http://www.cormorant.us.eom/PDF/2012.Gas.Well.Conference.pdf [retrieved on Oct. 7, 2014].

Bolt, David:: Hydraulic Dewatering, Technology, Performance, and Applications 7th European Gas Well Deliquification Conference, Sep. 24, 2012 (Sep. 24, 2012), XP55144958, Retrieved from the Internet:URL:http://www.alrdc.com/workshops/2012_2O12EuropeanGasWell/Private/06 EGWDC 2.012 Cormorant.pdf [retrieved on Oct. 7, 2014].

Putra, S.A., et al; "Design of Tubing Collar Inserts for Producing Gas Wells Below Their Critical Velocity"; SPE Paper 71554; 2001 SPE Annual Technical Conference and Exhibition held in New Orleans, Louisiana; Sep. 30-Oct. 3, 2001.

Ali, A.J., et al.; "Investigation of New Tool to Unload Liquids From Stripper-Gas Wells"; SPE Paper 85136; SPE Annual Technical Conference and Exhibition held in Denver Colorado; Oct. 5-8, 2003.

Takamasa, T., et al; "Experimental Study of Gas-Liquid Two Phase-Flow Affected by Wall Surface Wettability"; International Journal of Heat and Fluid Flow 29; pp. 1593-1602; Journal Homepage: www.elsevier.com/locate/ijff; 2008.

PCT International Search Report, Application No. PCT/US2012/052756 dated Apr. 12, 2013.

* cited by examiner

METHOD FOR PRODUCING HYDROCARBON GAS FROM A WELLBORE AND VALVE ASSEMBLY

PRIORITY CLAIM

The present application is a National Stage (§371) application of PCT/EP2013/052756, filed Feb. 12, 2013, which claims priority from European Application 12155337.4, filed Feb. 14, 2012, each of which are hereby incorporated by reference in their entirety.

The invention relates to a method for producing hydrocarbon gas from a hydrocarbon reservoir via a wellbore. The wellbore is for instance a hydrocarbon production wellbore.

At a first stage of hydrocarbon gas production, also referred to as primary recovery, also called natural depletion, the reservoir pressure is considerably higher than the bottomhole pressure inside the wellbore. This high pressure differential drives hydrocarbon gas toward the wellbore and up to surface. Herein, the gas rate is sufficient to carry associated condensate and water up the wellbore to surface in a stable manner. The primary recovery stage reaches its limit when the reservoir pressure has decreased to a level at which the production rates are no longer economical. For gas reservoirs, the percentage of the initial hydrocarbon gas produced during natural depletion varies, depending on the reservoir, well and surface details. Said percentage may be between 10% and 90%, for instance between 10 to 30%.

Stable production stops when the gas rate declines as the gas velocity becomes insufficient to lift all liquids from the wellbore. These liquids will accumulate downhole and impair production. This process is referred to as liquid loading.

A second stage of hydrocarbon gas production is referred to as secondary recovery, during which an external fluid such as water or gas may be injected into the gas reservoir through one or more injection wells which are in fluid communication with the production well. To extend stable production to lower flow rates reduce the bottomhole pressure or increase the pressure differential to increase hydrocarbon gas production, an artificial lift system may be used. Thus, the reservoir pressure can be maintained at a higher level for a longer period and the hydrocarbon gas, including associated liquids, can be displaced towards surface. The secondary recovery stage reaches its limit when the injected fluid is produced in considerable amounts from the production well and/or the production is no longer economical. The successive use of primary recovery and secondary recovery in a gas reservoir may produce for instance about 30 to 40% of the hydrocarbons in the reservoir.

Enhanced Gas Recovery refers to techniques for increasing the amount of hydrocarbon gas which can be extracted from the gas reservoir. Enhanced Gas Recovery is sometimes referred to as tertiary recovery as it is typically carried out after secondary recovery, but it can be initiated at any time during the production life of the hydrocarbon reservoir. As many hydrocarbon gas production wellbores are nowadays near the end of their secondary recovery production life or have already passed the secondary recovery stage, Enhanced Gas Recovery is becoming increasingly important to maintain the gas production capacity and extend the production life of the gas well.

Thus, at the stage of secondary recovery and/or Enhanced Gas Recovery the hydrocarbon gas from subsurface earth formations can no longer be produced by the inherent formation pressure of the gas in the formation. Water vapour in the gas stream may condense on the way to surface. As the reservoir pressure in a gas well depletes, there may be insufficient velocity to lift all liquids from the wellbore. In time these liquids accumulate and impair production. Water droplets coalesce, run down tubulars, and collect at the bottom of the wellbore. Eventually, the fluid level rises above the level of the well perforations. This is referred to as liquid loading and restricts gas production.

A possible technique for gas well deliquification includes installing a velocity string. A velocity string is a relatively small-diameter tubing string run inside the production tubing of a well as a remedial treatment to resolve liquid-loading problems. Installing a velocity string reduces the flow area and increases the flow velocity to enable liquids to be carried to surface via the wellbore. Velocity strings are commonly run using coiled tubing as a velocity string conduit and provide a cost effective solution to liquid loading in gas wells.

However, while the velocity string increases the flow velocity inside the velocity string and consequently lifts liquids to surface, the smaller tubing size also increases the frictional pressure drop across the velocity string which leads to a loss of production capacity.

An object of the invention to provide an improved method for producing hydrocarbon gas from a wellbore.

This object is achieved by a method for producing hydrocarbon gas from a wellbore, the wellbore comprising:

- a wellhead,
- a production zone,
- a production tubing having an inner diameter, the production tubing extending inside the wellbore from the wellhead to the production zone,
- a velocity string having an outer diameter smaller than the inner diameter of the production tubing, the velocity string being installed inside the production tubing so that an annulus is formed between the outer wall of the velocity string and the inner wall of the production tubing, said annulus being in fluid communication with the production zone, the velocity string extending at least over a part of the production tubing, the method comprising:

- allowing gas to flow from the production zone through the velocity string, said gas forming a primary gas stream,
- controlling the flow of gas from the annulus between the outer wall of the velocity string and the inner wall of the production tubing to the primary gas stream by means of a control valve in such a manner that a controlled mass flow of said gas is combined with the primary gas stream.

The velocity string runs upwards from the production zone. The velocity string comprises tubing, for example sections of standard tubing which are connected together by threads. The velocity string has a predetermined inner diameter, which is designed to increase the flow rate of the primary gas stream so as to enable liquids to be entrained with the primary gas stream to surface. The inner diameter of the velocity string is designed so that it can be used during a predetermined period of time. As the reservoir pressure in the gas well continues to decrease over time, the inner diameter of the velocity string is thus designed so that the velocity string is still able to lift the liquids to surface until the end of said period of time. Consequently, when the velocity string is initially installed, the inner diameter of the velocity string is smaller than necessary for lifting the liquids to surface. As a result, at this stage, the flow capacity of the velocity string could be significantly lower than the capacity of the original production tubing. This leads to a loss of production capacity.

According to the invention, the loss of production capacity is compensated by combining the gas being accumulated from the production zone in the annulus between the velocity string and the production tube in a controlled manner with the primary gas stream inside the velocity string. The control valve controls the mixing of the gas from said annulus with the primary gas stream inside the velocity string in such a manner that the flow rate inside the velocity string is sufficient to lift liquids to surface while the flow rate in the annulus will be choked to avoid the velocity string to enter the liquid loading regime. Herein, the bottomhole pressure inside the wellbore decreases and the pressure gradient between the formation pressure of the gas in the formation and the bottomhole pressure inside the wellbore increases. At the same time, the mass flow of the gas from said annulus to the primary gas stream is controlled by means of the control valve such that the velocity string is still able to entrain the liquids upwards through the velocity string with the primary gas stream. In other words, as long as the reduction of the flow area by the velocity string is overdimensioned, the loss of production capacity is compensated for by supplying the controlled mass flow of the gas from the annulus to the primary gas stream inside the velocity string.

It is possible that the flow of gas from the annulus between the outer wall of the velocity string and the inner wall of the production tubing to the primary gas stream is controlled by means of the control valve in such a manner that the controlled mass flow of said gas that is combined with the primary gas stream is such that the flow rate of the primary gas stream inside the velocity string is adjusted to at least a minimal flow rate at which liquids can be lifted from the production zone through the velocity string or to a flow rate which exceeds said minimal flow rate, for example up to 10% or 20% greater than said minimal flow rate.

In this case, the flow rate inside the velocity string is not higher than necessary or scarcely higher than necessary. As a result, it is guaranteed that the liquids can be lifted from the production zone through the whole length of the velocity string while the production capacity of the wellbore is optimized.

It is possible that the wellbore comprises a valve assembly which is installed in the production tubing, wherein the valve assembly comprises a downhole safety valve and the control valve, wherein the control valve is installed below the downhole safety valve, and wherein the velocity string extends below the control valve.

The control valve may be integrated with the downhole safety valve. For example, the control valve is connected to the downhole safety valve using an adapter. In this case, the valve assembly comprises the downhole safety valve, the adapter and the control valve.

The downhole safety valve may be a surface controlled sub-surface safety valve (SC-SSSV). A surface-controlled subsurface safety valve (SC-SSSV) is generally installed at a depth of at least 50 m, for example at approximately 100 m below the wellhead.

The downhole safety valve provides emergency closure of the production tubing in the event of an emergency. The downhole safety valve is designed to be fail-safe, i.e. the wellbore is isolated in the event of failure or damage to the surface production control equipment.

The velocity string may extend downwards within the production tubing below the control valve to the production zone, i.e. the velocity string may extend from the control valve to the production zone or from a position below the control valve to the production zone. For example, the velocity string is hung from the control valve using a hanger.

The gas from the annulus between the outer wall of the velocity string and the inner wall of the production tubing flows into the production gas stream inside the velocity string by means of the integrated control valve of the valve assembly. Thus, the annulus gas is mixed with the production gas stream at the location of the control valve below the downhole safety valve of the valve assembly. Then, the production gas stream including the mixed annulus gas is transported upwards through the valve assembly, i.e. via the downhole safety valve, and through the production tubing to the wellhead.

It is possible that the downhole safety valve can be controlled between a closed position and an open position, wherein the downhole safety valve is biased to the closed position by means of a spring member, and wherein the downhole safety valve is controlled to the open position, against the bias of the spring member, by means of a piston member that is subjected to fluid pressure by means of a control line extending from the wellhead to the downhole safety valve.

In this case, the downhole safety valve is surface-controlled. The downhole safety valve is typically controlled by varying fluid pressure in the control line which extends from the wellhead to the downhole safety valve, for example through an annular space between the outer wall of the production tubing and the wellbore. The control line may be a steel conduit having an outer diameter which is less than a centimeter. Under normal operating conditions, the fluid pressure in the control line is controlled such that the piston member actuates the downhole safety valve to the open position, contrary to the bias of the spring member. In the case of an emergency, the fluid pressure is released from the control line, so that the downhole safety valve is closed off by means of the spring member.

It is possible that the control line comprises a first branch that is connected to the downhole safety valve and a second branch that is connected to the control valve for controlling the mass flow of the gas from the annulus between the outer wall of the velocity string and the inner wall of the production tubing that is combined with the production gas stream.

The valve assembly may have a first fluid inlet to which the control line is connected. The first branch of the control line runs from said first fluid inlet to a second fluid inlet that is arranged in the downhole safety valve. For example, the first branch is formed by an internal conduit of the valve assembly. The second fluid inlet of the downhole safety valve is connected to a chamber that houses the piston member. The second branch of the control line runs from said first fluid inlet in the valve assembly to a third fluid inlet that is arranged in the control valve. The fluid pressure in the control line can be controlled above the safety valve opening pressure so as to meter the gas from the annulus between the outer wall of the velocity string and the inner wall of the production tubing that is combined with the production gas stream.

It is possible that the downhole safety valve is urged to the open position, against the bias of the spring member, when the fluid pressure in the first branch is greater than an operating fluid pressure, and wherein the control valve is configured to be controlled between a closed position and an open position by varying the fluid pressure in the second branch within a range between a lower fluid pressure and a higher fluid pressure, wherein the lower fluid pressure of said range is greater than the operating fluid pressure.

In this case, the fluid pressure in the control line is controlled such that the fluid pressure in the second branch is within said range between the lower fluid pressure and the higher fluid pressure so that the control valve is controlled between the closed position and the open position. At the same time, when the control valve is operated at the lowest fluid pressure of said varying fluid pressure range for controlling the control valve, the fluid pressure in the first branch remains greater than the operating fluid pressure, i.e. the control valve can be controlled so as to meter the mass flow of annulus gas to the primary gas stream while the downhole safety valve remains open under normal operating conditions.

It is possible that the control valve may be controlled to at least one partially open position between the closed position and the open position. Thus, the control valve defines a passageway having an adjustable flow area. For example, the control valve can be adjusted between the closed position and the open position in an incremental or continuously variable manner.

It is possible that the valve assembly comprises an adapter that is interposed between the downhole safety valve and the control valve. The adapter is situated between the downhole safety valve and the control valve. The adapter is used to install the downhole safety valve and the integrated control valve in the production tubing.

It is possible that the valve assembly can be removed out of the production tubing. In this case, the valve assembly is wireline retrievable. In the event of failure, malfunction or breakdown of the valve assembly, it can be retrieved to surface. The valve assembly can be repaired and re-arranged in the production tubing or a replacing valve assembly can be installed in the production tubing to continue gas production.

Also, it is possible that the production tubing is pre-existing in the wellbore, wherein the valve assembly is retrofitted in the pre-existing production tubing. Thus, the method according to the invention can be used with existing gas production wellbores. When the velocity string is installed in a pre-existing wellbore to solve liquid loading problems, the control valve can be arranged at the same time to minimize production capacity losses.

It is possible that the flow of gas from the annulus between the outer wall of the velocity string and the inner wall of the production tubing is directed to the wellhead separate from the primary gas stream, wherein the controlled mass flow of said gas is combined by means of the control valve with the primary gas stream downstream of the wellhead. In this case, the downhole safety valve may be provided with two passageways–a first passageway for the primary gas stream and a second passageway for allowing the gas from the annulus between the outer wall of the velocity string and the inner wall of the production tubing to flow through the downhole safety valve. Said annulus gas flows to surface while being separated from the primary gas stream flowing inside the production tubing. The annulus gas is combined with the primary gas stream downstream of the wellhead by means of the control valve. This leads to the same advantages as described above.

The invention also relates to a wellbore for producing hydrocarbon gas, comprising:

- a wellhead,
- a production zone,
- a production tubing having an inner diameter, the production tubing extending inside the wellbore from the wellhead to the production zone,
- a velocity string having an outer diameter smaller than the inner diameter of the production tubing, the velocity string being installed inside the production tubing so that an annulus is formed between the outer wall of the velocity string and the inner wall of the production tubing, said annulus being in fluid communication with the production zone allowing gas to flow from the production zone through the velocity string, said gas forming a primary gas stream, the velocity string extending at least over a part of the production tubing,
- a control valve for controlling the flow of gas from the annulus between the outer wall of the velocity string and the inner wall of the production tubing to the primary gas stream in such a manner that a controlled mass flow of said gas is combined with the primary gas stream.

The wellbore according to the invention may comprise any of the features described in the claims and the description above, either individually or in any combination of features. The same or similar operation, technical effects and advantages apply to the wellbore as described above in respect of the method for producing hydrocarbon gas from a wellbore.

In an embodiment, the control valve is configured to control the flow of gas from the annulus between the outer wall of the velocity string and the inner wall of the production tubing to the primary gas stream in such a manner that the controlled mass flow of said gas that is combined with the primary gas stream is such that the flow rate of the primary gas stream inside the velocity string is adjusted to the minimal flow rate at which liquids can be lifted from the production zone through the velocity string or to a flow rate that is slightly larger than said minimal flow rate.

The wellbore may be provided with a sensor for measuring the flow rate of the primary gas stream inside the velocity string. Said sensor is connected to a control unit so as to send a measuring signal representative for said flow rate to the control unit. The control unit is connected to the control valve so as to send a control signal to the control valve based on said measuring signal such that the desired controlled mass flow of said annulus gas is combined with the primary gas stream.

The inventions also relates to a valve assembly for use in a production tubing of a wellbore for producing hydrocarbon gas, the valve assembly comprising:

- a downhole safety valve, wherein the downhole safety valve defines a first interior passageway, and wherein the downhole safety valve can be controlled between a closed position and an open position, and wherein the downhole safety valve is biased to the closed position by means of a spring member, and wherein the downhole safety valve can be controlled to the open position, against the bias of the spring member, by means of a piston member that can be actuated by fluid pressure,
- a control valve, wherein the control valve defines a second interior passageway that is in fluid communication with the first interior passageway of the downhole safety valve, and wherein the control valve is configured to control the mass flow of a gas flowing from outside of the control valve into the second interior passageway of the control valve.

The valve assembly according to the invention may comprise one or more of the features described in the claims and the description above, either individually or in any combination of features. In particular, as described above, the valve assembly is a retrofit assembly, i.e. the valve assembly can be retrofitted to a pre-existing production tubing of a gas production wellbore. The same or similar operation, technical effects and advantages apply to the valve assembly as described above in respect of the method for producing hydrocarbon gas from a wellbore.

The invention furthermore relates to a method for producing hydrocarbon gas from a wellbore, the wellbore comprising:

a wellhead, a production zone, a production tubing having an inner diameter, the production tubing extending inside the wellbore from the wellhead to the production zone, a velocity string having an outer diameter smaller than the inner diameter of the production tubing, the velocity string being installed inside the production tubing so that an annulus is formed between the outer wall of the velocity string and the inner wall of the production tubing, said annulus being in fluid communication with the production zone, said annulus having a flow area which is larger than the flow area of the interior of the velocity string, the velocity string extending at least over a part of the production tubing, the method comprising:

blocking gas flow from the production zone through the velocity string, and allowing gas to flow from the production zone through the annulus between the outer wall of the velocity string and the inner wall of the production tubing, controlling the flow of gas from the annulus between the outer wall of the velocity string and the inner wall of the production tubing to the wellhead by means of a control valve in such a manner that a controlled mass flow of said gas flows up to the wellhead.

In this case, the gas from the production zone is allowed to flow upwards through the annulus instead of through the velocity string proper. For example, a plug is set inside the velocity string while the control valve is installed at the top of the velocity string. When the annular flow area of the annulus is larger than the flow area of the velocity string, the gas flow rate reduction can be mitigated for some period of time. At a later stage however, when the formation pressure has been reduced further, the gas from the production zone is allowed to flow through the velocity string to reap maximum benefit. Then, the method for producing hydrocarbon gas from a wellbore as described above and claimed in claims 1-11 can be used.

It is possible according to this method that a valve assembly is installed in the production tubing, wherein the valve assembly comprises a downhole safety valve and the control valve, wherein the control valve is installed below the downhole safety valve, and wherein the velocity string extends below the control valve, and wherein the control valve controls the flow of gas from the annulus between the outer wall of the velocity string and the inner wall of the production tubing to the interior of the production tubing extending from the valve assembly up to the wellhead.

The invention will now be explained, merely by way of example, with reference to the accompanying drawings.

Figure 2:
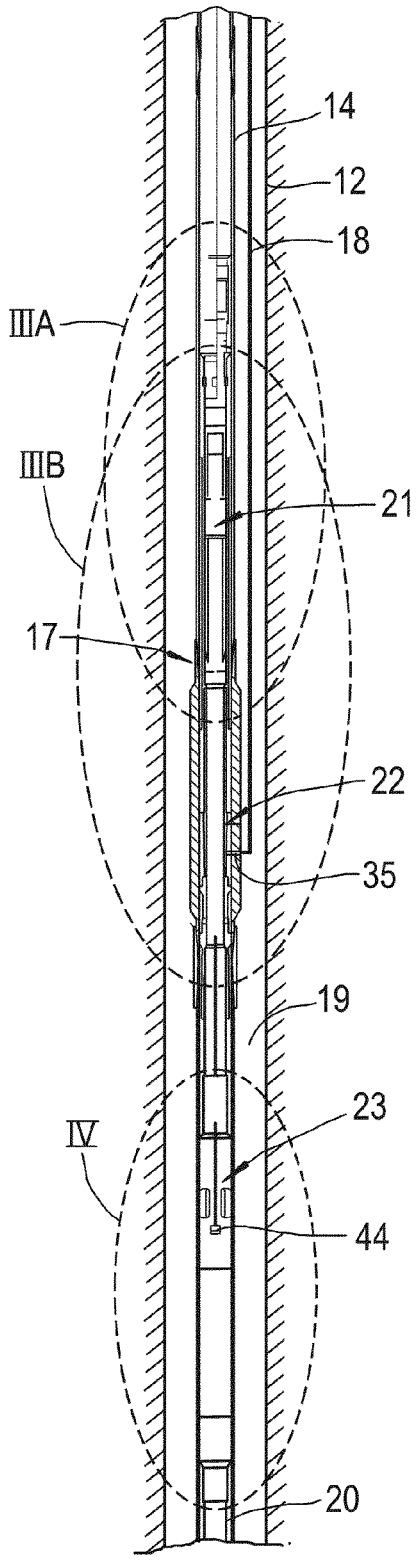
FIG. 2 shows a cross-sectional view of the valve assembly according to II in FIG. 1.
Figure 3A:
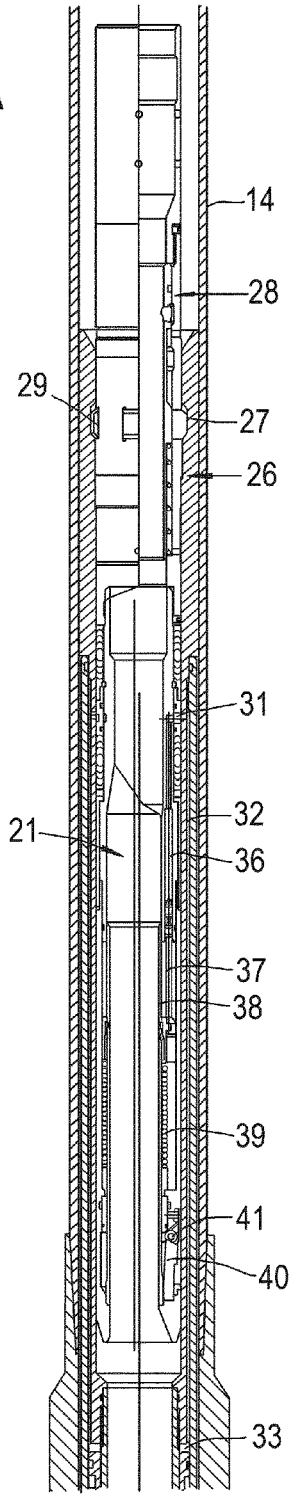

FIG. 3*a* shows a cross-sectional view of detail IIIA in FIG. 2, in particular illustrating the downhole safety valve of the valve assembly.

Figure 3B:
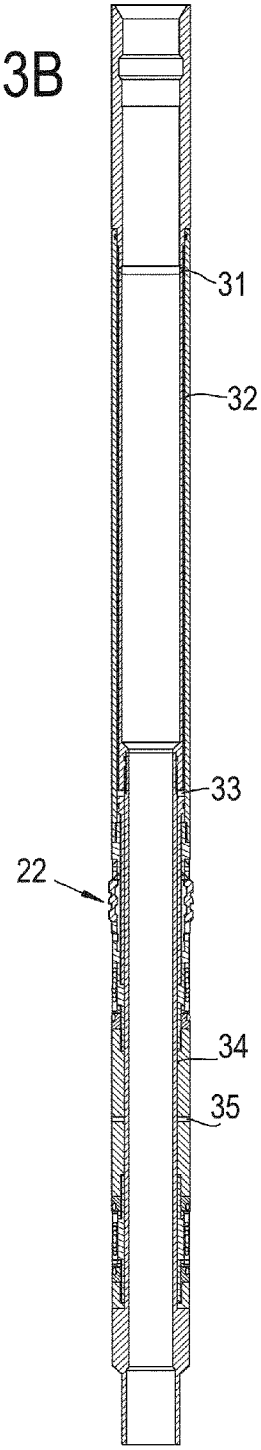

FIG. 3*b* shows a cross-sectional view of detail IIIB in FIG. 2, wherein the downhole safety valve has been omitted.

Figure 4:
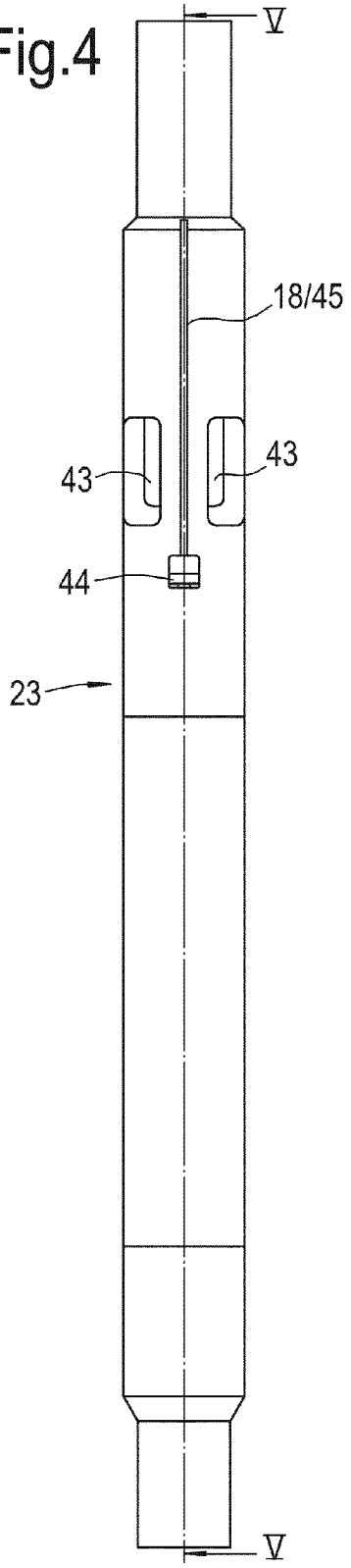

FIG. 4 shows a cross-sectional view of detail IV in FIG. 2, in particular illustrating the control valve of the valve assembly.

Figure 5:
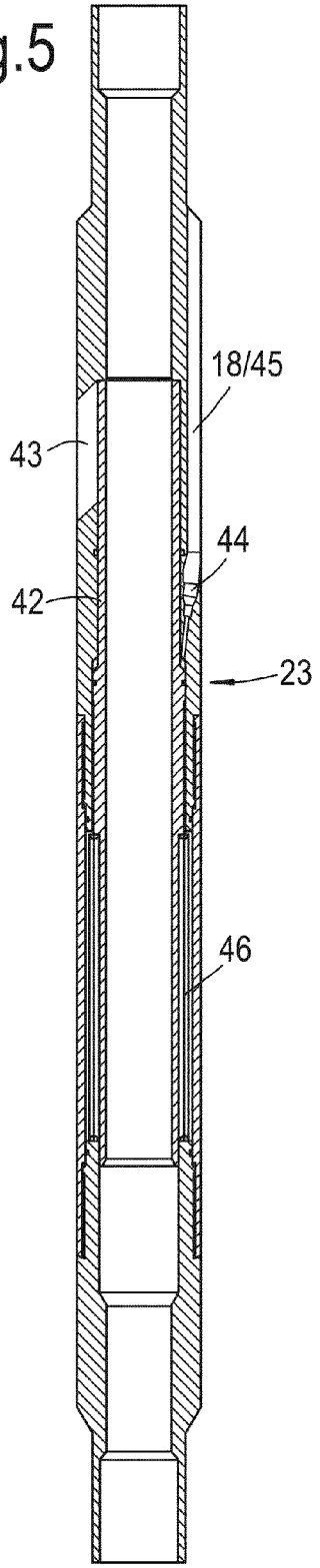

FIG. 5 shows a cross-sectional view according to V-V in FIG. 4.

Figure 6:
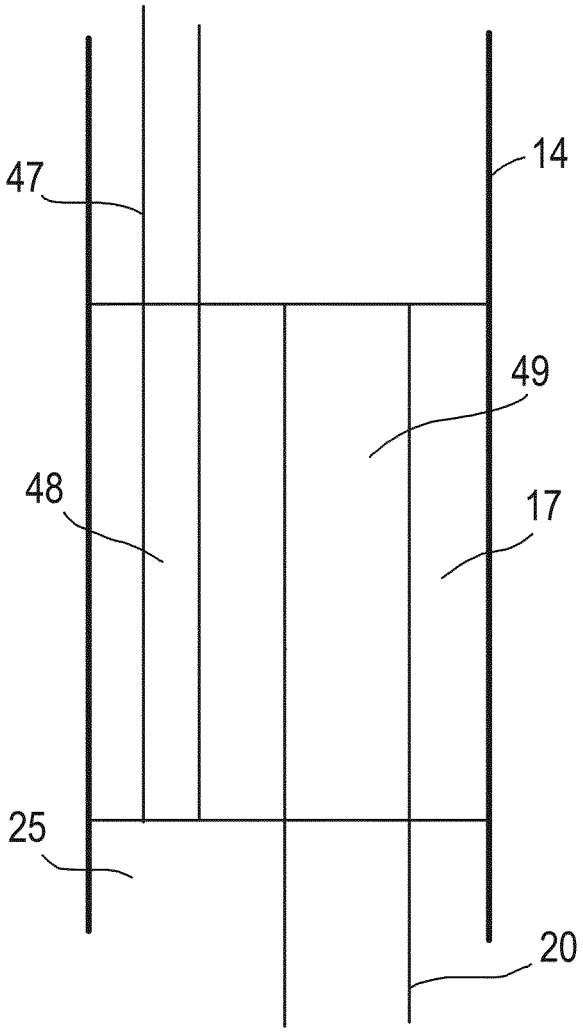

FIG. 6 shows an alternative embodiment of a hydrocarbon gas production well in accordance with the present invention.

Figure 1:
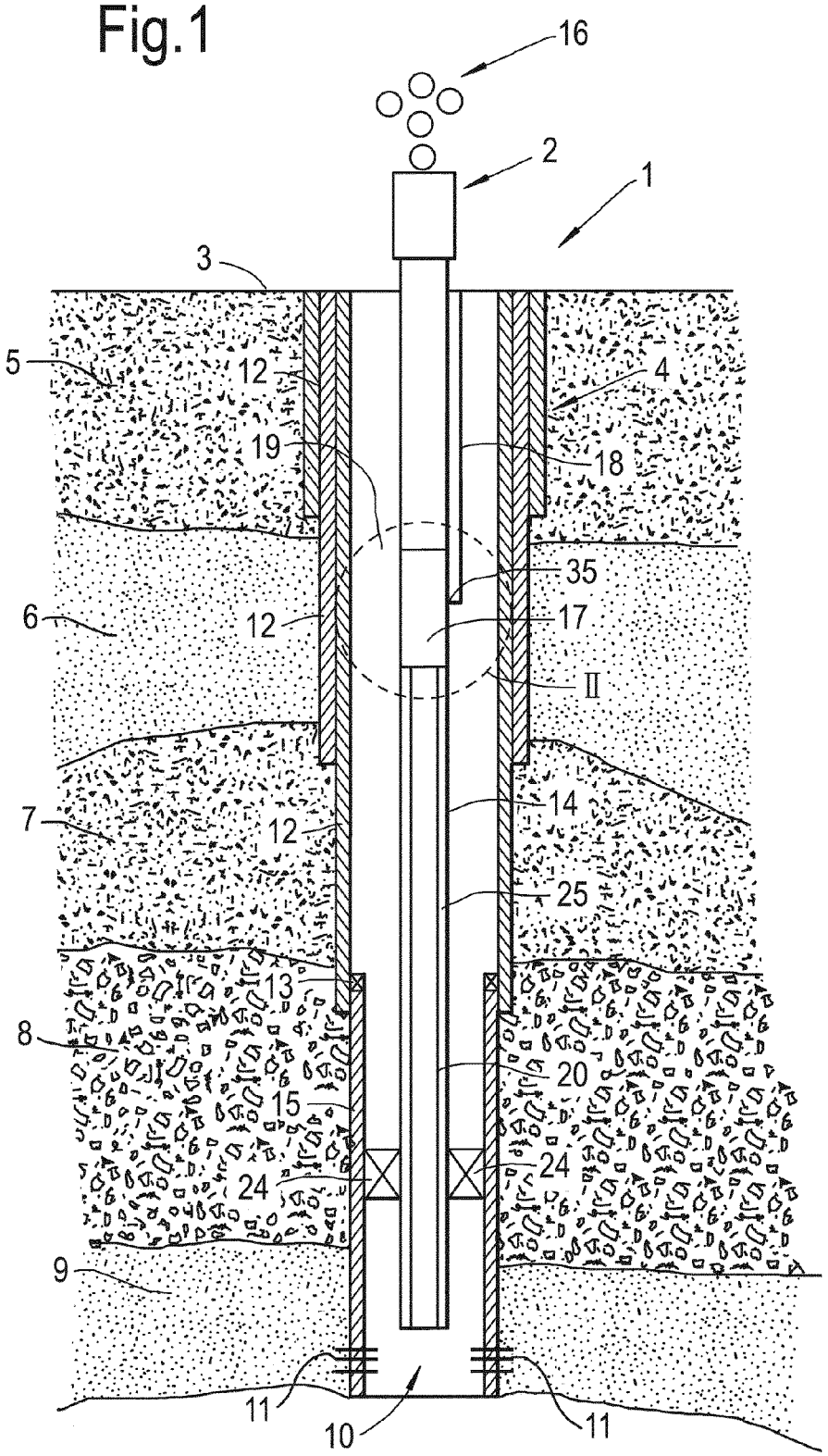
FIG. 1 shows a schematic cross-sectional view of an exemplary embodiment of a hydrocarbon gas production well in accordance with the present invention.

FIG. 1 schematically shows a hydrocarbon gas production well 1 according to the invention. The well 1 comprises a wellbore or borehole 4 which has been drilled from a wellhead 2 at the surface 3 through a number of earth formations 5, 6, 7, 8 up to a production formation 9. The production formation 9 comprises hydrocarbon gas. The wellbore 4 is lined with casings 12 and a liner 15 which is suspended from the lowermost casing 12 by means of a liner hanger 13. The liner 15 extends from the lowermost casing 12 to the production formation 9 and comprises perforations 11 for allowing fluid communication from the production formation 9 to a production zone 10 of the hydrocarbon gas production well 1. The production zone 10 may be situated at a depth of at least 1 km below the wellhead 2.

A production tubing 14 is disposed within the casings 12 and the liner 15 of the wellbore 4. The production tubing 14 may be constructed in various ways. For example, the production tubing 14 comprises sections of standard production tubing which are connected together by threads. The production tubing 14 extends from the wellhead 2 of the hydrocarbon production well 1 to the production zone 10. Hydrocarbon gas may be conveyed from the production zone 10 to the wellhead 2 at the surface 3 through the interior of the production tubing 14. A Christmas tree 16 is installed on the wellhead 2 so as to control fluid flow in and out of the wellbore 4.

A valve assembly 17 is installed within the production tubing 14. The valve assembly 17 comprises a downhole safety valve 21, an adapter 22 and an integrated control valve 23, as will be explained in more detail below. An annular space 19 is defined between the outer wall of the production tubing 14 and the casings 12. The annular space 19 is referred to as the A-annulus, i.e. the A-annulus is the void between the production tubing 14 and the smallest casing string 12. A hydraulic control line 18 extends from the surface 3 within the annular space 19 to a first fluid inlet 35 of the valve assembly 17 so as to control the downhole safety valve 21 and the integrated control valve 23.

In this exemplary embodiment, the downhole safety valve 21 of the valve assembly 17 is constructed as a surface-controlled subsurface safety valve (SC-SSSV). The downhole safety valve 21 may be situated at a depth greater than 50 m, for example at approximately 100 m. The downhole safety valve 21 provides emergency closure of the production tubing 14 in the event of an emergency. The downhole safety valve 21 is designed to be fail-safe, i.e. the wellbore 4 is isolated in the event of failure or damage to the surface production control equipment.

A packer member 24 is arranged between the production tubing 14 and the liner 15 so as to secure in place a lower portion of the production tubing 14 and to substantially isolate the A-annulus 19 from the interior of the production tubing 14. For example, the packer member 24 comprises a means for securing the packer member 24 against the wall of the liner 15, such as a slip arrangement, and a means for establishing a reliable hydraulic seal to isolate the A-annulus 19, typically by means of an expandable elastomeric element. The portion of the production tubing 14 below the packer member 24 is generally referred to as the tail.

The hydrocarbon production well 1 according to the invention comprises a velocity string 20. For example, the velocity string 20 comprises sections of standard tubing which are connected together by threads. The velocity string 20 has an outer diameter that is smaller than the inner diameter of the production tubing 14. The velocity string 20 is installed inside the production tubing 14 so that an annulus 25 is formed between the outer wall of the velocity string 20 and the inner wall of the production tubing 14.

In this exemplary embodiment, the velocity string 20 extends from the valve assembly 17 to the production zone 10. Hydrocarbon gas may be conveyed from the production zone 10 via the interior of the velocity string 20, through the valve assembly 17 and via the production tubing 14 above the valve assembly 17 to the wellhead 2 at the surface 3. The gas that flows up to surface through the velocity string is referred to as the production gas stream. The annulus 25 between the outer wall of the velocity string 20 and the inner wall of the production tubing 14 is in fluid communication with the production zone 10.

The valve assembly 17 is shown in more detail in FIGS. 2, 3*a*, 3*b* 4 and 5. In this exemplary embodiment, the valve assembly 17 is installed in the production tubing 14 in a wireline retrievable manner using a landing nipple 26 (see FIG. 3*a*). The landing nipple 26 comprises a locking profile 27 that is formed by a circumferential groove. A lock mandrel 28 is run within the landing nipple 26. The lock mandrel 28 comprises locking keys 29 that can be, for example, displaced between an locked inner position, a spring-loaded outer position and a locked outer position. The lower end of the lock mandrel 29 is provided with thread for connecting the valve assembly 17. Thus, the valve assembly 17 can be retrofitted to a pre-existing production tubing 14 and can also be removed out of the production tubing 14.

The adapter 22 of the valve assembly 17 is shown in more detail in FIG. 3B. The adapter 22 is situated between the downhole safety valve 21 and the integrated control valve 23. The adapter 22 is used to connect the downhole safety valve 21 and the integrated control valve 23 together as valve assembly 17 in the production tubing 14. The first fluid inlet 35 of the valve assembly 17, to which the control line 18 is connected, is provided in the adapter 22.

FIG. 3*a* shows the downhole safety valve 21 of the valve assembly 17. The downhole safety valve 21 comprises an internal passageway that can be closed by a flapper body 40. The flapper body 40 is pivotable about a pivot axis 41—FIG. 3*a* shows the open position of the downhole safety valve. The flapper body 40 can be opened by a sleeve member 38 that is connected to a rod piston 37. The rod piston 37 is received in a fluid chamber 36 such that it can be displaced in the vertical direction together with the sleeve member 38. In FIG. 3*a*, the sleeve member 38 has moved to a lower position thereby pushing the flapper body 40 open. The downhole safety valve 21 is biased to the closed position by means of a spring member 39.

In exemplary embodiment, the downhole safety valve 21 is surface-controlled by fluid pressure in the control line 18. The control line 18 comprises a first branch that extends from the first fluid inlet 35 of the valve assembly 17 via the fluid conduits 32, 33, 34 to a second fluid inlet 31 that is provided in the downhole safety valve 21. The second fluid inlet 35 is in fluid communication with the fluid chamber 36.

Under normal operating conditions, the rod piston 37 is subjected to an operating fluid pressure by means of the control line 18 so that the rod piston 37 urges the sleeve member 38 down, contrary to the bias of the spring member 39, so that the sleeve member 38 pushes the flapper body 40 to the open position. In the case of an emergency, the fluid pressure in the control line 18 is released so that the rod piston 37 and the sleeve member 38 are moved upward under the influence of the spring member 39. As a result, the flapper body 40 closes off the internal passageway of the downhole safety valve 21. Thus, the downhole safety valve 21 can be controlled between the open and closed positions.

The control line 18 comprises a second branch that extends from the first fluid inlet 35 of the valve assembly 17 to a third fluid inlet 44 that is provided in the control valve 23. As shown in FIG. 2, the velocity string 20 is connected by means of a connector body to the lower end of the control valve 23. The control valve 23 is shown in more detail in FIGS. 4 and 5.

In this exemplary embodiment, the control valve 23 comprises a plurality of mix ports 43. The control valve 23 comprises a sleeve piston 42 that can be displaced between an upper closed position (see FIG. 5) and a lower open position (not shown). In the upper closed position, the control valve 23 closes off the mix ports 43. The sleeve piston 42 is biased to the upper closed position by means of a spring member 46.

The sleeve piston 42 can be moved downwards by controlling the fluid pressure in the control line 18 thereby opening the mix ports 43 in a continuous variable manner. The mix ports 43 provide an adjustable flow area. When the sleeve piston 42 is moved downwards from the upper closed position, the mix ports 43 provide a fluid communication between the annulus 25 between the outer wall of the velocity string 20 and the inner wall of the production tubing 14.

The pretension provided by the spring member 46 of the control valve 23 is such that the sleeve piston 42 can be controlled between the upper closed position and the lower open position by varying the fluid pressure in the control line 18 within a range that is greater than the operating fluid pressure for the downhole safety valve 21. In other words, the control range for the control valve 23 is between a lower fluid pressure and a higher fluid pressure, wherein the lower fluid pressure of said range is greater than the operating fluid pressure for the downhole safety valve 23.

As a result, the fluid pressure in the control line 18 is controlled such that the sleeve piston 42 of the control valve 23 can be displaced between the upper closed position and the lower open position, contrary to the bias of the spring member 46. At the same time, when the fluid pressure in the control line 18 results in the lowest fluid pressure of the control range for the control valve 23, the fluid pressure in the fluid chamber 36 of the downhole safety valve 21 remains greater than the operating fluid pressure. Thus, the control valve 23 can be controlled so as to meter the mass flow of annulus gas to the primary gas stream while the downhole safety valve 21 remains closed under normal operating conditions.

The operation of the valve assembly according to the invention is as follows.

The inner diameter of the velocity string 20 is designed to increase the flow rate of the primary gas stream so as to enable liquids to be entrained with the primary gas stream to surface. The inner diameter of the velocity string 20 is designed so that it can be used during a predetermined period of time. As the reservoir pressure in the gas well 1 continues to decrease over time, the inner diameter of the velocity string 20 is thus designed so that the velocity string 20 is still able to lift the liquids to surface until the end of said period of time. Consequently, when the velocity string 20 is initially installed, the inner diameter of the velocity string 20 is smaller than necessary for lifting the liquids to surface. As a result, at this stage, the pressure gradient between the pressure of the gas in the production formation 9 and the pressure in the production zone 10 of the wellbore 4 is decreased in a superfluous manner.

The production capacity is optimized by combining gas that flows from the production zone 10 into the annulus 25 between the velocity string 20 and the production tube 14 in a controlled manner, using the control valve 23, with the primary gas stream inside the velocity string 20. The control valve 23 controls the mixing of the gas from said annulus 25 with the primary gas stream inside the velocity string 20 in such a manner that the pressure gradient between the formation pressure of the gas in the production formation 9 and the bottomhole pressure in the production zone 10 of the wellbore 4 increases. At the same time, the mass flow of the gas from said annulus to the primary gas stream is controlled by means of the control valve 23 such that the velocity string 20 is still able to entrain the liquids upwards through the velocity string 20 with the primary gas stream. In other words, as long as the reduction of the flow area by the velocity string 20 is overdimensioned, a controlled mass flow of the gas from the annulus is combined with the primary gas stream inside the velocity string 20.

Optionally, the flow of gas from the annulus 25 between the outer wall of the velocity string 20 and the inner wall of the production tubing 14 to the primary gas stream is controlled by means of the control valve 23 in such a manner that the flow rate of the primary gas stream inside the velocity string 20 is adjusted to the minimal flow rate at which liquids can be lifted from the production zone 10 through the velocity string 20 or to a flow rate that is slightly greater than said minimal flow rate, for example, not more than 10% or 20% greater than said minimal flow rate.

In this case, the flow rate inside the velocity string 20 is not higher than necessary or scarcely higher than necessary. As a result, it is guaranteed that the liquids can be lifted from the production zone 10 through the whole length of the velocity string 20 and up to surface 3 while the production capacity of the wellbore 4 is optimized.

Before the control valve 23 is operated as described above, it may be possible at the stage immediately after the installation of the velocity string in the wellbore to block gas flow from the production zone through the velocity string, for example by means of a plug in the velocity string (not shown), whereas the gas is allowed to flow from the production zone through the annulus between the outer wall of the velocity string and the inner wall of the production tubing.

When said annulus has a flow area which is larger than the flow area inside the velocity string, the gas flow rate is reduced with respect to the gas flow rate when the gas were transported through the velocity string. Thus, the gas flow rate is increased using the velocity string, but to a lesser degree than when the gas were directed through the interior of the velocity string immediately after its installation. The gas from the annulus between the outer wall of the velocity string and the inner wall of the production tubing is allowed to flow to the interior of the production tubing above the valve assembly by means of the control valve in such a manner that a controlled mass flow of said gas flows into the production tubing above the valve assembly.

After some time, the formation pressure in the production formation 9 has decreased to such an extent that the gas flow rate in the annulus between the outer wall of the velocity string and the inner wall of the production tubing becomes too low to lift liquids up to surface. At this stage, the plug is removed out of the interior of the velocity string so that the method as described earlier above can be used.

FIG. 6 schematically illustrates a further embodiment of the invention. In this case, the valve assembly 17 comprises at least two passages 48, 49. The first passage 48 allows gas from the annulus 25 between the outer wall of the velocity string 20 and the inner wall of the production tubing 14 to flow from below the valve assembly 17 via the first passage 48 into a tubing 47 that extends to the wellhead 2. The tubing 47 is installed in the interior of the production tubing 14 above the valve assembly 17.

The gas being transported through the interior of the velocity string 20 forms the primary gas stream. Said gas flows through the second passage 49 of the valve assembly 17. The second passage 49 opens into the production tubing 14 above the valve assembly 17, i.e. said gas flows up to the wellhead 2 through the interior of the production tubing 14 while it remains separated from the annulus gas inside the tubing 47.

Downstream of the wellhead 2, the annulus gas transported by the tubing 47 and the primary gas stream within the production tubing 14 are combined together by means of a control valve (not shown). The control valve is configured to combine a controlled mass flow of said annulus gas with the primary gas stream. As a result, the gas flow rate within the velocity string can also be adjusted to a desired level, i.e. to safeguard the lifting of liquids while not affecting the production capacity more than necessary.

The description above describes exemplary embodiments of the present invention for the purpose of illustration and explanation only. It will be apparent to the skilled person that many modifications and changes to the exemplary embodiments are possible without departing from the scope of the invention. It is noted that the features described above may also be combined, each individually or in any combination of features, with one or more of the features of the claims.

The invention claimed is:

1. A method for producing hydrocarbon gas from a wellbore, the wellbore comprising:

a wellhead, a production zone, a production tubing having an inner diameter, the production tubing extending inside the wellbore from the wellhead to the production zone, a velocity string having an outer diameter smaller than the inner diameter of the production tubing, the velocity string being installed inside the production tubing so that an annulus is formed between the outer wall of the velocity string and the inner wall of the production tubing, said annulus being in fluid communication with the production zone, the velocity string extending at least along a part of the production tubing, the method comprising:

allowing gas to flow from the production zone through the velocity string, said gas forming a primary gas stream, controlling the flow of gas from the annulus between the outer wall of the velocity string and the inner wall of the production tubing to the primary gas stream by means of a control valve wherein a controlled mass flow of said gas is combined with the primary gas stream, wherein a control line comprises a first branch and a second branch wherein said first branch is connected to a downhole safety valve which can be controlled between a closed position and an open position, wherein the downhole safety valve is biased to the closed position by means of a spring member, and wherein the second branch is connected to the control valve, wherein the downhole safety valve is urged to the open position, against the bias of the spring member, when the fluid pressure in the first branch is greater than an operating fluid pressure, and wherein the control valve is configured to be controlled between a closed position and an open position by varying the fluid pressure in the second branch within a range between a lower fluid pressure and a higher fluid pressure, wherein the lower fluid pressure of said range is greater than the operating fluid pressure.

2. The method of claim 1, the wellbore comprising a valve assembly which is installed in the production tubing, wherein the valve assembly comprises the downhole safety valve and the control valve, the control valve being installed below the downhole safety valve, and wherein the velocity string extends below the control valve.

3. The method of claim 1, wherein the downhole safety valve is controlled by means of a piston member that is subjected to fluid pressure by means of the control line extending from the wellhead to the downhole safety valve.

4. The method of claim 1, wherein the control valve is controllable to at least one partially open position between the closed position of the control valve and the open position of the control valve.

5. The method of claim 1, wherein the flow of gas from the annulus between the outer wall of the velocity string and the inner wall of the production tubing to the primary gas stream is controlled by means of the control valve in such a manner that the controlled mass flow of said gas that is combined with the primary gas stream is such that the flow rate of the primary gas stream inside the velocity string is adjusted to the minimal flow rate at which liquids can be lifted from the production zone through the velocity string or to a flow rate that is slightly larger than said minimal flow rate.

6. The method of claim 2, wherein the valve assembly comprises an adapter interposed between the downhole safety valve and the control valve.

7. The method of claim 2, wherein the valve assembly is removable out of the production tubing.

8. The method of claim 2, wherein the production tubing is pre-existing in the wellbore, and wherein the valve assembly is retrofitted in the pre-existing production tubing.

9. The method of claim 1, wherein the flow of gas from the annulus between the outer wall of the velocity string and the inner wall of the production tubing is directed to the wellhead separate from the primary gas stream, and wherein the controlled mass flow of said gas is combined by means of the control valve with the primary gas stream downstream of the wellhead.

10. A wellbore for producing hydrocarbon gas, comprising:

a wellhead, a production zone, a production tubing having an inner diameter, the production tubing extending inside the wellbore from the wellhead to the production zone, a velocity string having an outer diameter smaller than the inner diameter of the production tubing, the velocity string being installed inside the production tubing so that an annulus is formed between the outer wall of the velocity string and the inner wall of the production tubing, said annulus being in fluid communication with the production zone allowing gas to flow from the production zone through the velocity string, said gas forming a primary gas stream, the velocity string extending at least along a part of the production tubing, a control valve for controlling the flow of gas from the annulus between the outer wall of the velocity string and the inner wall of the production tubing to the primary gas stream in such a manner that a controlled mass flow of said gas is combined with the primary gas stream, a downhole safety valve, a control line comprising a first branch and a second branch wherein said first branch is connected to the downhole safety valve which can be controlled between a closed position and an open position, wherein the downhole safety valve is biased to the closed position by means of a spring member, and wherein the second branch is connected to the control valve, wherein the downhole safety valve is urged to the open position, against the bias of the spring member, when the fluid pressure in the first branch is greater than an operating fluid pressure, and wherein the control valve is configured to be controlled between a closed position and an open position by varying the fluid pressure in the second branch within a range between a lower fluid pressure and a higher fluid pressure, wherein the lower fluid pressure of said range is greater than the operating fluid pressure.

11. A wellbore as claimed in claim 10, wherein the control valve is configured to control the flow of gas from the annulus between the outer wall of the velocity string and the inner wall of the production tubing to the primary gas stream in such a manner that the controlled mass flow of said gas that is combined with the primary gas stream is such that the flow rate of the primary gas stream inside the velocity string is adjusted to the minimal flow rate at which liquids can be lifted from the production zone through the velocity string or to a flow rate that is slightly larger than said minimal flow rate.

12. A valve assembly for use in a production tubing extending inside a wellbore from a wellhead to a production zone for producing hydrocarbon gas, said production tubing having an inner diameter, inside of which production tubing a velocity string having an outer diameter smaller than the inner diameter is installed so that an annulus is formed between the outer wall of the velocity string and the inner wall of the production tubing, said annulus being in fluid communication with the production zone, the velocity string extending at least along a part of the production tubing, the valve assembly comprising:

a downhole safety valve, wherein the downhole safety valve defines a first interior passageway, and wherein the downhole safety valve can be controlled between a closed position and an open position; and a control valve, wherein the control valve defines a second interior passageway that is in fluid communication with the first interior passageway of the downhole safety valve, and wherein the control valve is configured to control a mass flow of a gas flowing from outside the control valve into the second interior passageway of the control valve, a control line comprising a first branch that is connected to the downhole safety valve and a second branch that is connected to the control valve for controlling the mass flow of gas flowing from the annulus between the velocity string and the production tubing, the mass flow of gas being combined with a production gas stream in the production tubing, wherein the downhole safety valve is biased to the closed position by means of a spring member, and wherein the second branch is connected to the control valve, wherein the downhole safety valve can be urged to the open position, against the bias of the spring member, when the fluid pressure in the first branch is greater than an operating fluid pressure, and wherein the control valve is configured to be controlled between a closed position and an open position by varying the fluid pressure in the second branch within a range between a lower fluid pressure and a higher fluid pressure, wherein the lower fluid pressure of said range is greater than the operating fluid pressure.

13. The valve assembly of claim 12, wherein the downhole safety valve can be controlled to the open position by means of a piston member that can be actuated by fluid pressure.

14. The valve assembly of claim 13, wherein the control line is a hydraulic control line.

15. A method for producing hydrocarbon gas from a wellbore, the wellbore comprising:

a wellhead, a production zone, a production tubing having an inner diameter, the production tubing extending inside the wellbore from the wellhead to the production zone, a velocity string having an outer diameter smaller than the inner diameter of the production tubing, the velocity string being installed inside the production tubing so that an annulus is formed between the outer wall of the velocity string and the inner wall of the production tubing, said annulus being in fluid communication with the production zone, said annulus having a flow area which is larger than the flow area of the interior of the velocity string, the velocity string extending at least along a part of the production tubing, the method comprising the steps of:

temporarily blocking gas flow from the production zone through the velocity string, and allowing gas to flow from the production zone through the annulus between the outer wall of the velocity string and the inner wall of the production tubing, controlling the flow of gas from the annulus between the outer wall of the velocity string and the inner wall of the production tubing to the wellhead wherein a controlled mass flow of said gas flows up to the wellhead, resuming allowing gas to flow from the production zone through the velocity string, said gas forming a primary gas stream, whereby controlling the flow of gas from the annulus between the outer wall of the velocity string and the inner wall of the production tubing to the primary gas stream by means of a control valve wherein a controlled mass flow of said gas is combined with the primary gas stream, wherein a control line comprises a first branch and a second branch wherein said first branch is connected to a downhole safety valve which can be controlled between a closed position and an open position, wherein the downhole safety valve is biased to the closed position by means of a spring member, and wherein the second branch is connected to the control valve, wherein the downhole safety valve is urged to the open position, against the bias of the spring member, when the fluid pressure in the first branch is greater than an operating fluid pressure, and wherein the control valve is configured to be controlled between a closed position and an open position by varying the fluid pressure in the second branch within a range between a lower fluid pressure and a higher fluid pressure, wherein the lower fluid pressure of said range is greater than the operating fluid pressure.

* * * * *